US010773880B2

(12) United States Patent
Thiessen

(10) Patent No.: US 10,773,880 B2
(45) Date of Patent: Sep. 15, 2020

(54) BURNER TUBE HEAT EXCHANGER FOR A STORAGE TANK

(71) Applicant: VIRO Rentals, Inc., Lloydminster (CA)

(72) Inventor: Lester James Thiessen, Neilburg (CA)

(73) Assignee: Viro Rentals, Inc., Lloydminster, AB (CA)

( * ) Notice: Subject to any disclaimer, the term of this patent is extended or adjusted under 35 U.S.C. 154(b) by 558 days.

(21) Appl. No.: 14/178,919

(22) Filed: Feb. 12, 2014

(65) Prior Publication Data

US 2014/0224191 A1 Aug. 14, 2014

Related U.S. Application Data

(60) Provisional application No. 61/763,603, filed on Feb. 12, 2013.

(51) Int. Cl.

| | |
|---|---|
| ***B65D 88/74*** | (2006.01) |
| ***F24H 9/14*** | (2006.01) |
| ***F24H 1/18*** | (2006.01) |
| ***F24H 1/20*** | (2006.01) |
| ***F24H 9/18*** | (2006.01) |

(52) U.S. Cl.

CPC ..... *B65D 88/744* (2013.01); *B65D 88/748* (2013.01); *F24H 1/186* (2013.01); *F24H 1/205* (2013.01); *F24H 1/206* (2013.01); *F24H 9/1836* (2013.01); *Y10T 137/6579* (2015.04)

(58) Field of Classification Search

CPC ..... H05B 3/82; B65D 88/744; B65D 88/748

See application file for complete search history.

(56) References Cited

U.S. PATENT DOCUMENTS

| | | | | | |
|---|---|---|---|---|---|
| 1,723,082 | A | * | 8/1929 | Schumann | B65D 88/744 122/32 |
| 1,862,065 | A | * | 6/1932 | Rowe | F24H 9/2021 122/32 |
| 2,780,218 | A | * | 2/1957 | Allen | B44D 3/166 126/110 B |
| 3,138,150 | A | * | 6/1964 | Hyer | F17C 9/02 122/33 |

(Continued)

FOREIGN PATENT DOCUMENTS

| | | | | |
|---|---|---|---|---|
| DE | 1116699 B | * | 11/1961 | B65D 88/744 |
| GB | 1286971 A | * | 8/1972 | B65D 88/744 |
| GB | 1386314 A | * | 3/1975 | B65D 88/744 |

*Primary Examiner* — Steven B McAllister
*Assistant Examiner* — Steven Anderson, II

(57) ABSTRACT

A heating assembly for heating a liquid storage tank includes a heat exchanger tank supported in one wall of the storage tank to extend into the storage tank in contact with liquid stored therein. The heat exchanger tank contains a heat exchanger fluid therein which is heated by a burner tube extending through the heat exchanger tank whereby heat is only transferred to the liquid in the storage tank through the heat exchanger fluid. A controller actuates the burner head of the burner tube to maintain temperature of the heat exchanger fluid between upper and lower temperature limits. The operation of the burner head is interrupted in response to temperature of the liquid in the storage tank exceeding an upper limit, or fluid level in the heat exchanger tank being below a lower limit as determined by respective sensors.

15 Claims, 4 Drawing Sheets

(56) References Cited

U.S. PATENT DOCUMENTS 3,227,204 A * 1/1966 Dibert ..... F23D 11/28 239/133
3,757,745 A * 9/1973 Miller ..... F22B 7/12 122/136 R
4,172,445 A * 10/1979 Sellers ..... F23C 3/004 122/18.3
4,415,075 A * 11/1983 McNesky ..... B01D 1/0017 202/177
4,480,173 A * 10/1984 Butterfield ..... A47J 31/56 122/4 A
4,550,711 A * 11/1985 Griffiths ..... A47J 37/12 126/343.5 A
4,570,702 A * 2/1986 Stafford ..... B01D 5/0012 122/367.3
4,593,178 A * 6/1986 Banta ..... F24H 9/1818 219/534
4,651,714 A * 3/1987 Granberg ..... F23D 14/12 122/149
4,666,587 A * 5/1987 Martin ..... B01D 1/00 196/46
4,690,102 A * 9/1987 Sundquist ..... C02F 1/16 122/14.3
4,790,268 A * 12/1988 Eising ..... F23C 3/004 122/136 R
4,797,534 A * 1/1989 Prager ..... H05B 3/141 219/505
4,803,343 A * 2/1989 Sotani ..... B65D 88/744 165/104.21
4,927,500 A * 5/1990 Martin ..... B01D 1/00 196/108
5,052,345 A * 10/1991 Bystrom ..... F24H 1/22 122/20 B
5,395,230 A * 3/1995 Ferguson ..... F23C 3/004 431/12
5,687,678 A * 11/1997 Suchomel ..... F24H 1/43 122/247
6,070,559 A * 6/2000 Schlesch ..... F22B 7/00 122/140.1
6,095,037 A * 8/2000 Savage ..... A47J 37/1223 210/167.28
6,394,042 B1 * 5/2002 West ..... F24H 1/28 110/234
7,293,606 B2 * 11/2007 Benoit ..... F23D 14/18 165/171
7,726,298 B2 6/2010 St. Denis
8,418,718 B2 * 4/2013 Hebblethwaite ..... B65D 90/028 137/143
8,875,619 B2 * 11/2014 Kijimoto ..... A47J 37/1247 99/403
2009/0199747 A1 * 8/2009 Laskowski ..... F23G 5/24 110/186
2011/0041781 A1 * 2/2011 Deivasigamani ..... F24H 1/186 122/18.1
2012/0222631 A1 * 9/2012 Lesage ..... F25B 25/005 122/18.5
2012/0301332 A1 * 11/2012 Clarke ..... F04B 23/04 417/364
2014/0048534 A1 * 2/2014 Thiessen ..... B65D 88/128 220/23.83
2014/0096832 A1 * 4/2014 Thiessen ..... E21B 43/34 137/1
2014/0245972 A1 * 9/2014 Thiessen ..... B65D 88/744 122/18.3
2015/0298900 A1 * 10/2015 Thiessen ..... B65D 88/744 122/18.31
2016/0169552 A1 * 6/2016 Nett ..... F28D 7/0058 122/18.4
2016/0334137 A1 * 11/2016 Pisani ..... F24H 1/40

* cited by examiner

BURNER TUBE HEAT EXCHANGER FOR A STORAGE TANK

This application claims the benefit under 35 U.S.C. 119(e) of U.S. provisional application Ser. No. 61/763,603, filed Feb. 12, 2013.

FIELD OF THE INVENTION

The present invention relates to a heat exchanger arranged to be received in a storage tank, for example an oil storage tank, in which the heat exchanger contains a heat exchanger fluid therein and receives the burner tube of a propane burner therethrough for heating the contents in the storage tank by communicating heat from the burner tube through the heat exchanger fluid. More particularly, the present invention relates to a heat exchanger for a burner tube in an oil storage tank which further includes a production passage extending through the heat exchanger fluid in the heat exchanger tank for heating produced hydrocarbons as they are directed through the production passage into the oil storage tank.

BACKGROUND

In oil production, it is common to locate an oil storage tank at an oil well site to produce hydrocarbons from the well directly into the oil storage tank. It is also known to provide a propane burner which directs exhaust into a burner tube extending into the oil storage tank for heating oil in the tank. Heating the oil assist in settling sand out of the oil to the bottom of the tank and assists with fluidity of the oil when subsequently pumping the oil into transport tanker trucks.

Occasionally oil is pumped from the oil storage tank into tanker trucks such that the level of oil in the storage tank falls below the elevation of the burner tube in the storage tank. The burner tube in this instance can become excessively hot such that there is danger of igniting volatile hydrocarbons in gaseous form surrounding the burner tube. Ignition of the fumes can cause explosions which damage the tank and are a safety concerns for operators of the storage tank or tanker trucks.

U.S. Pat. No. 7,726,298 by St. Denis discloses a method and apparatus for heating a liquid storage tank in place of a conventional burner tube. An engine is disposed in an engine compartment appended to a peripheral sidewall of the tank and an exhaust conduit extends into the interior of the liquid storage tank from the engine such that heat from hot exhaust gases passing through the exhaust conduit heats the interior of the liquid storage tank. The exhaust conduit can still become excessively hot and is in direct contact with volatile hydrocarbons in the storage tank such that the same risk of ignition and explosions as noted above remains present.

SUMMARY OF THE INVENTION

According to one aspect of the invention there is provided a heating assembly for use with a burner head for heating a liquid storage tank having walls surrounding a hollow interior arranged to contain a liquid therein, the assembly comprising:

a burner tube defining an exhaust passage communicating from an inlet end arranged to be coupled to the burner head to an outlet end arranged to be vented to atmosphere such that the exhaust passage is arranged to receive products of combustion from the burner head therethrough;

a heat exchanger tank surrounding a main portion of the burner tube so as to be arranged to contain a heat exchanger fluid therein about the main portion of the burner tube;

the heat exchanger tank being arranged to be received within the liquid storage tank such that heat is communicated from the burner tube to liquid in the liquid storage tank primarily through the heat exchanger fluid.

According to a second aspect of the present invention there is provided an oil storage tank comprising:

a main oil storage portion defined by tank walls surrounding a hollow interior arranged to contain oil therein;

a heat exchanger tank received within the main oil storage portion and containing a heat exchanger fluid therein separate from the oil contained in the main oil storage portion;

a burner tube having a main portion defining an exhaust passage communicating from an inlet end to an outlet end vented to atmosphere;

a burner head coupled to the inlet end of the burner tube such that the exhaust passage is arranged to receive products of combustion from the burner head therethrough from the inlet end to the outlet end;

the main portion of the burner tube extending through the heat exchanger tank such that heat is communicated from the burner tube to oil in the storage tank primarily through heat exchanger fluid in the heat exchanger tank.

The heat exchanger fluid surrounding the burner tube maintains fluid contact with the burner tube to prevent the burner tube from reaching excessive temperature which could otherwise risk igniting vapours in the oil storage tank. The heat exchanger tank also limits direct contact of the burner tube with hydrocarbons in the storage tank to further minimize the risk of igniting hydrocarbons in the oil storage tank.

Preferably the heat exchanger tank is arranged to be supported within the oil storage tank such that the burner tube cannot directly communicate with the hollow interior of the oil storage tank and heat is only communicated from the burner tube to oil in the storage tank through the heat exchanger fluid.

Preferably a volume of the heat exchanger tank is fixed about the burner tube. An overflow tank may be located externally of the heat exchanger tank in which an overflow passage is provided in communication between the overflow tank and the heat exchanger tank so as to be arranged to permit expansion of the heat exchanger fluid from the heat exchanger tank into the overflow tank.

When a fluid level monitor is arranged to monitor a level of heat exchanger fluid in the heat exchanger tank, preferably a burner head controller is arranged to cease operation of the burner head responsive to a level of the heat exchanger fluid as monitored by the fluid level monitor falling below a prescribed lower level limit.

Similarly, when a heat exchanger temperature monitor is arranged to monitor a temperature of the heat exchanger fluid in the heat exchanger tank, the burner head controller is preferably arranged to i) cease operation of the burner head responsive to a temperature of the heat exchanger fluid as monitored by the heat exchanger temperature monitor exceeding a prescribed upper temperature limit; and ii) actuate operation of the burner head responsive to a temperature of the heat exchanger fluid as monitored by the heat exchanger temperature monitor falling below a prescribed lower temperature limit.

Preferably a storage temperature monitor is also provided and arranged to monitor a temperature of the liquid in the liquid storage tank. In this instance the controller is preferably arranged to also cease operation of the burner head responsive to a temperature of the liquid as monitored by the storage temperature monitor exceeding a prescribed upper temperature limit.

It is further preferred that only the main portion of the burner tube is arranged to be received within the oil storage tank and the main portion is fully surrounded by the heat exchanger tank by supported the heat exchanger tank in communication through a boundary wall of the storage tank.

In a preferred embodiment, the heat exchanger fluid is glycol, however other suitable heat exchanger fluids could be used.

The inlet end and the outlet end of the burner tube preferably communicate through a common wall of the heat exchanger tank so as to be arranged to communicate through a common wall of the oil storage tank.

The heat exchanger tank is preferably mounted in sealing engagement with one of the walls of the oil storage tank to extend generally horizontally inwardly from an upright perimeter wall of the storage tank. For example when the tank has a cylindrical side wall extending horizontally between two opposing end walls, the heat exchanger tank preferably extend inwardly from one of the end walls. Alternatively, when the tank has an upright cylindrical side wall, preferably the heat exchanger tank extends generally radially inwardly from the side wall.

The heat exchanger tank may comprise perimeter walls and a perimeter flange projecting outwardly from the perimeter walls about a circumference of the heat exchanger tank in which the perimeter flange is arranged to be mounted in sealing engagement about a perimeter of an opening in the wall of the oil storage tank. The perimeter flange may be defined by a perimeter edge of an end wall at one end of the heat exchanger tank. The perimeter flange preferably includes spaced apart mounting apertures formed therein so as to be arranged to secure the flange to the perimeter of the opening in the wall of the oil storage tank using threaded fasteners.

The heat exchange is well suited for use with a production tank arranged to receive produced hydrocarbons therein directly from a well. In this instance, the heating assembly may further include a production passage communicating through the heat exchanger tank between an inlet end of the production passage arranged to receive produced fluid from a well therein to outlet of the production passage arranged for communication with the hollow interior of the storage tank such that the production passage is in heat exchanging relationship with the burner tube through the heat exchanger fluid.

Preferably the production passage follows a sinuous path through the heat exchanger tank at a location below the burner tube adjacent a bottom end of the heat exchanger tank.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
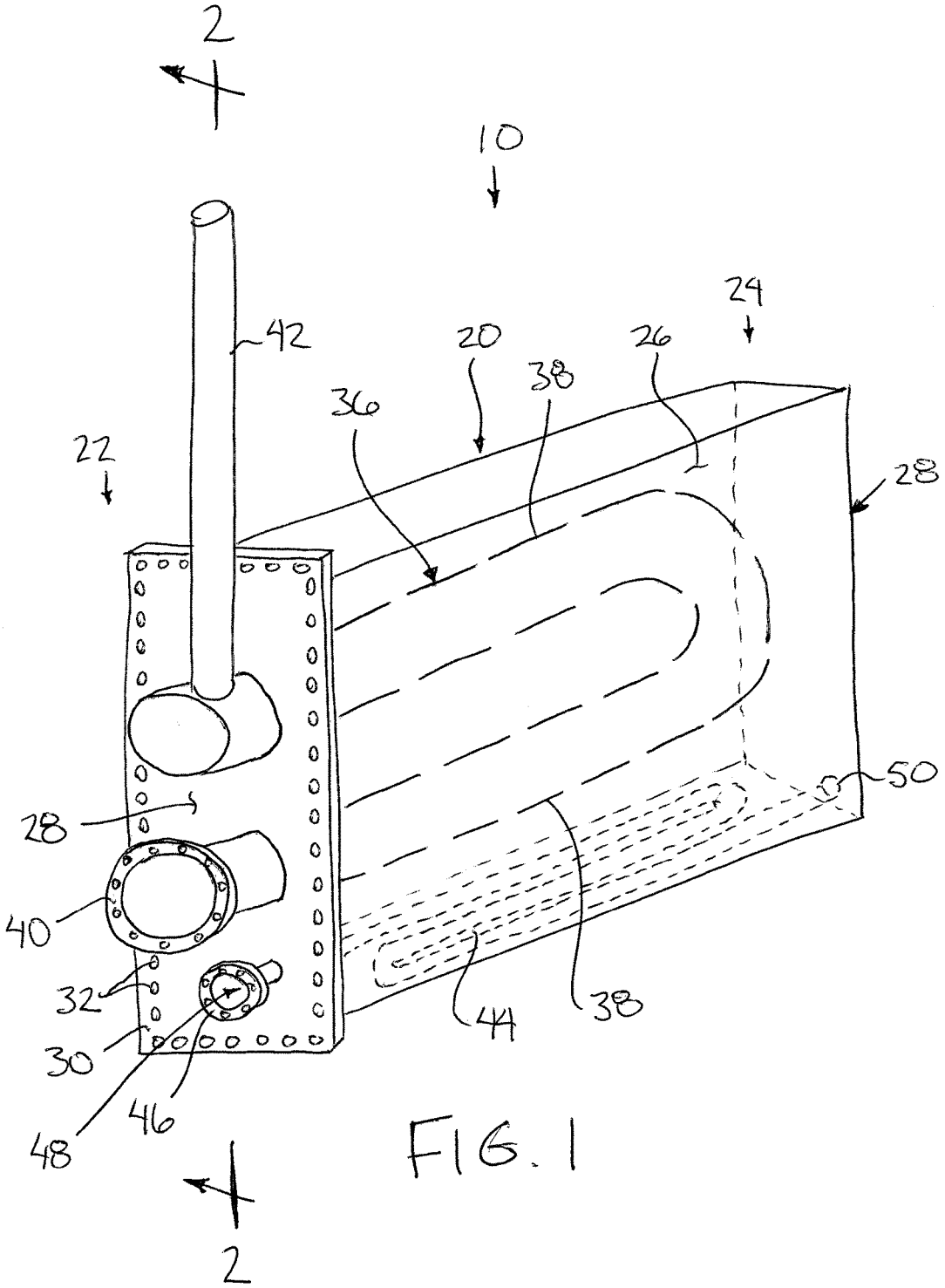
FIG. 1 is a perspective view of a first embodiment of the heating assembly.
Figure 2:
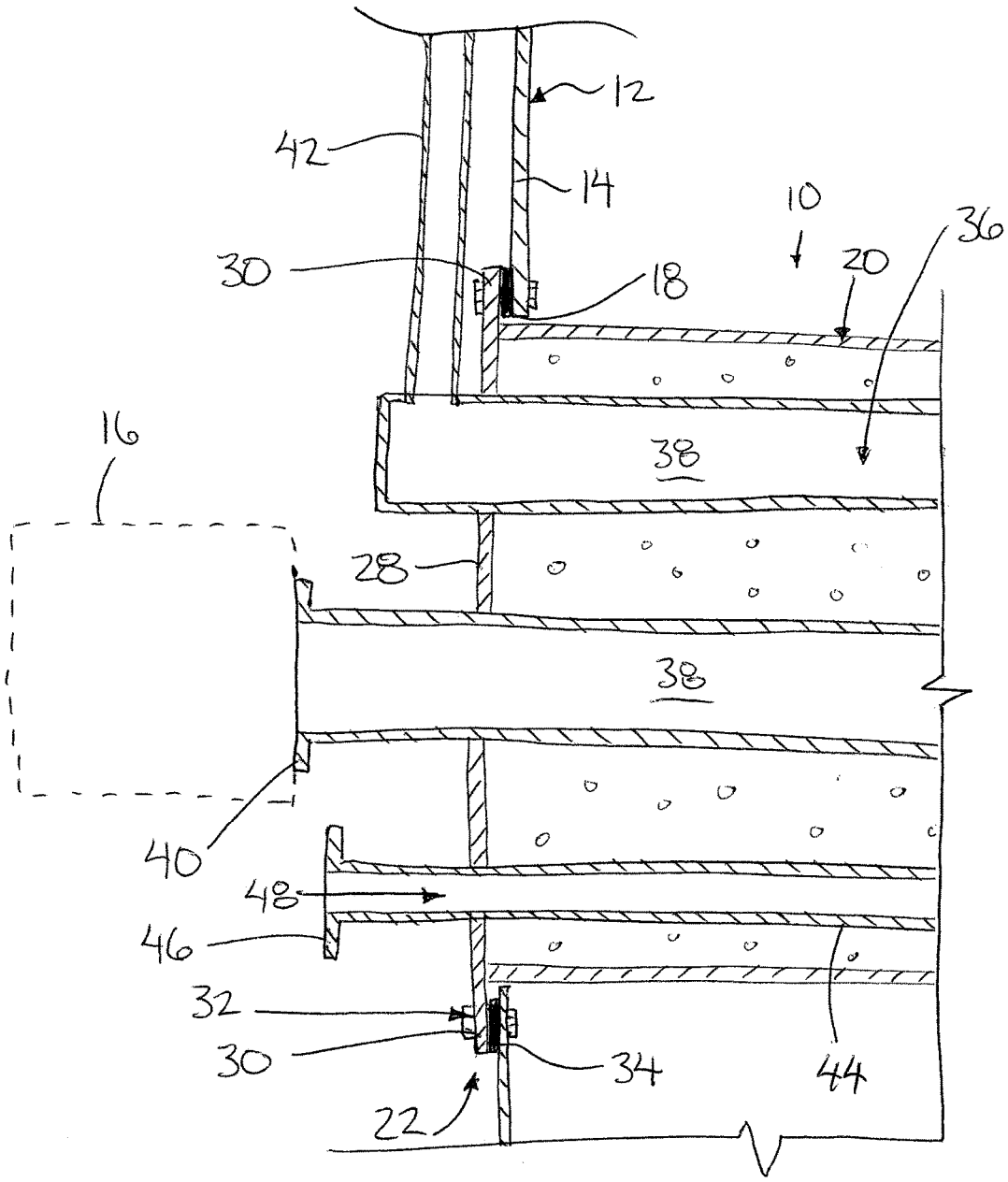
FIG. 2 is a sectional view of the heating assembly according to the first embodiment along the line 2-2 in FIG. 1.

Referring to the accompanying figures, there is illustrated a heating assembly generally indicated by reference numeral 10. The assembly 10 is suited for heating a liquid storage tank 12 having tank boundary walls 14 surrounding the hollow interior which defines a main liquid storage portion for storing liquid, for example oil therein. The heating assembly 10 is used with a burner head 16, for example a propane burner and is mounted within the oil storage tank in place of a conventional burner tube extending into the tank for heating the oil therein.

Although various embodiments are shown in the accompanying figures, the common features of the various embodiments will first be described.

The assembly 10 is mounted into a suitable opening 18 formed in an upright one of the walls 14 of the tank. A heat exchanger tank 20 of the assembly extends into the storage tank through the opening 18 so as to be elongate and extend generally horizontally inward into the tank from a first end 22 at the wall of the tank to an inner second end 24. The tank 20 is fully closed on all sides by respective side walls 26 and enclosed at both of the first and second ends by respective ends walls 28 such that the interior of the heat exchanger tank is a fixed closed volume containing a heat exchanger fluid therein which fills the tank such that the heat exchanger fluid within the heat exchanger tank is isolated from and kept separate from the stored liquid within the storage tank 12 that receives the heat exchanger tank 20 therein.

At the first end of the tank 20, the end wall 28 comprises a generally vertically oriented end plate which protrudes beyond the side walls about the full perimeter edge thereof to define a perimeter flange 30 extending about a full circumference of the heat exchanger tank at the first end thereof. The perimeter flange overlaps the side wall of the oil storage tank within which the heat exchanger tank is mounted about the full perimeter of the opening 18. Mounting apertures 32 are located at circumferentially spaced positions about the perimeter flange so as to permit mounting to the tank wall about the perimeter of the opening using suitable threaded fasteners 33 for example. A gasket 34 may be provided about the perimeter of the opening 18 of the tank wall to be clamped between the storage tank and the perimeter mounting flange of the heat exchanger tank so that the heat exchanger tank is mounted in sealing engagement with the storage tank wall about the full perimeter thereof.

The assembly further includes a burner tube 36 which is generally U-shaped so as to comprise two elongate sections 38 extending horizontally and longitudinally substantially between the first and second ends of the heat exchanger tank. The two sections 38 are joined at the second end of the tank by a curved section to define the U-shape of the burner tube.

A lowermost one of the two sections 38 protrudes through the end wall 28 at the first end of the tank to define an inlet of an exhaust passage defined by the burner tube. A suitable bolt flange 40 about the inlet permits coupling to a burner head 16 for receiving the products of combustion therefrom in use to heat the burner tube and thus heat the oil in the storage tank as described in further detail below.

The uppermost section 38 of the burner tube similarly protrudes through the end wall 28 at the first end of the heat exchanger tank above the inlet. The portion of the second section protruding to the exterior is coupled to a vertical stack 42 to define an outlet of the exhaust passage defined by the burner tube which is vented to atmosphere.

The main portion of the burner tube between the inlet and outlet ends thereof as defined primarily by the first and second sections 38 and the curved section therebetween is fully contained within the heat exchanger tank. The heat exchanger tank is in turn mounted within the storage tank wall so that the main portion of the burner tube is the only portion received within the storage tank and also such that the main portion is fully surrounded by heat exchanger fluid contained within the heat exchanger tank. In a preferred embodiment, the heat exchanger fluid is glycol. Regardless of the type of heat exchanger fluid, the heat exchanger tank is mounted such that heat can only be communicated from the burner tube to the oil in the main oil storage portion of the storage tank through the heat exchanger fluid in the heat exchanger tank. This ensures no direct communication between the burner tube and the oil in the storage tank.

In use, the heating assembly is installed in a storage tank by providing a suitable opening in the upright wall of the tank so that the heat exchanger tank can be substantially fully inserted into the oil storage tank to extend longitudinally and horizontally inward from the first end of the tank wall to the second end terminating internally within the oil storage tank. Using the gasket and bolts through the perimeter mounting flange the first end of the heat exchanger tank is mounted in sealing engagement about the perimeter of the opening in the storage tank wall.

The burner head is coupled to the inlet of the burner tube and operated such that the products of combustion from the burner head are directed through the burner tube from the inlet to the outlet to heat up the burner tube and in turn heat up the heat exchanger fluid surrounding the burner tube. The heat transferred to the fluid is in turn transferred to the oil through the increased exterior surface area of the heat exchanger tank.

Figure 3:
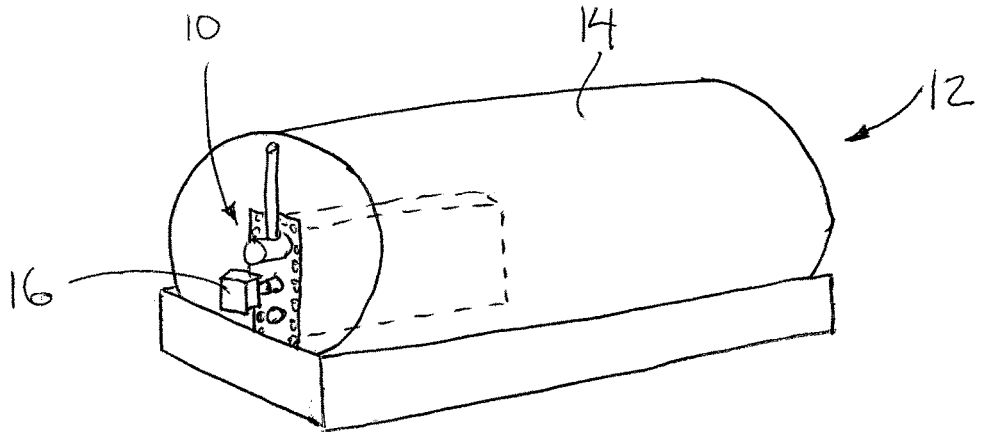
FIG. 3 is a perspective view of the heating assembly according to the first embodiment of FIG. 1, shown supported on a horizontal tank.

As shown in FIG. 3, when the tank includes a cylindrical wall extending horizontally between two opposing end walls, the heat exchanger tank is typically mounted in one of the upright end walls.

Figure 4:
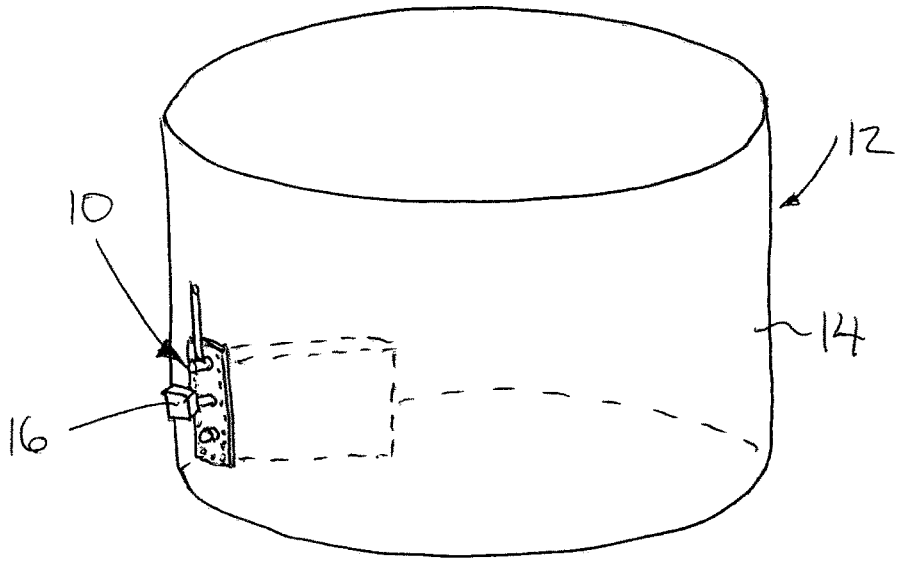
FIG. 4 is a perspective view of the heating assembly according to the first embodiment of FIG. 1, shown supported on an upright tank.

Alternatively, as shown in FIG. 4, when the storage tank comprises an upright cylindrical side wall, typically the heat exchanger tank is mounted in an opening in the cylindrical wall.

Turning now more particularly to the first embodiment of FIGS. 1 through 4, the assembly 10 in this instance further includes a production passage 44 in the form of an elongate pipe extending through the heat exchanger tank to be surrounded by heat exchanger fluid therein. The production passage extends from a first end protruding through the end wall 28 at the first end of the heat exchanger tank at a location below the burner tube to a second end which is open to the hollow interior of the main oil storage portion of the storage tank.

The first end of the production passage includes the bolt flange 46 at the exterior of the heat exchanger tank to permit coupling to suitable oil production equipment to receive produced oil directly therein, for example a production tank 47 containing a produced hydrocarbon therein, thus defining an inlet 48 of the production passage. Produced fluids are communicated from the inlet towards an opposing outlet 50 defined by the second end of the production passage at the second end of the heat exchanger tank.

The production passage is comprised of plural lengths of pipe joined by curved sections to define a sinuous path from the inlet to the outlet through the heat exchanger fluid. The winding and non-linear path of the production passage increases the duration that the produced fluids are in heat exchanging relationship with the heat exchanger fluid.

Connecting oil production equipment to the inlet of the production passage also allows heat to be transferred from the burner tube to the produced fluids in the production passage 44 by transferring heat across the heat exchanger fluid in the heat exchanger tank surrounding both the burner tube and the production passage.

Figure 5:
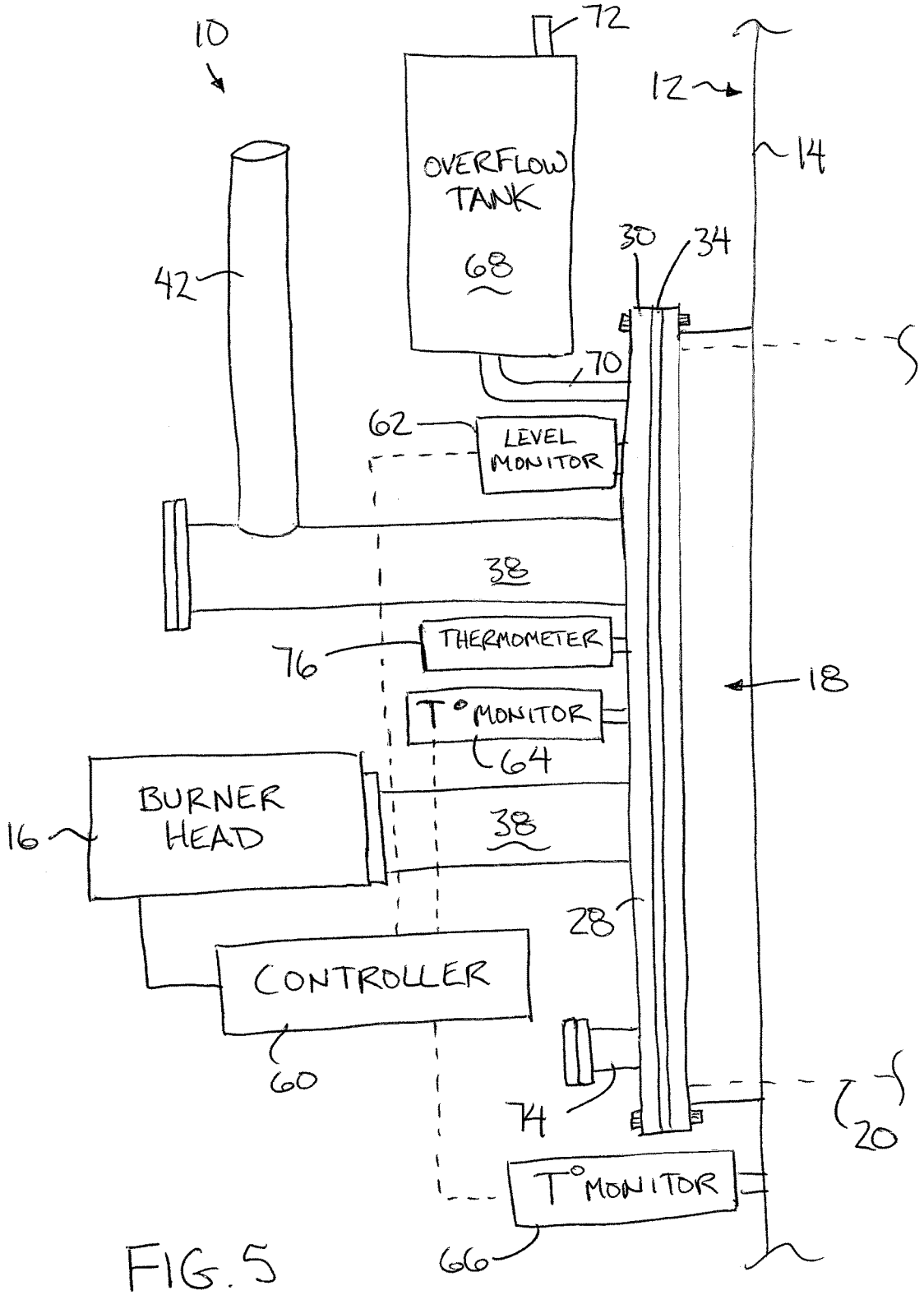
FIG. 5 is a schematic representation of a sectional view along the line 2-2 in FIG. 1 according to a second embodiment.

Turning now more particularly to the embodiment of FIG. 5, the structure of the heat exchanger tank is substantially identical to the embodiment of FIGS. 1 through 4; however, additional controls are provided. In further embodiments, the additional controls may also be used in combination with the production passage 44.

As shown in FIG. 5, a controller 60 is provided which controls operation of the burner head 16. The controller 60 works in cooperation with various sensors as described herein. One of the sensors is a heat exchanger temperature monitor 64 mounted on the outer end wall 28 of the heat exchanger tank 20 at an intermediate height between the burner head and the exhaust portion of the burner tube. The heat exchanger temperature monitor 64 is arranged to monitor a temperature of the heat exchanger fluid in the heat exchanger tank. The monitored temperature is relayed to the controller with all other monitored data. In this instance, the controller 60 is arranged to both: i) actuate operation of the burner head responsive to a temperature of the heat exchanger fluid as monitored by the heat exchanger temperature monitor falling below a prescribed lower temperature limit, and ii) cease operation of the burner head responsive to a temperature of the heat exchanger fluid as monitored by the heat exchanger temperature monitor exceeding a prescribed upper temperature limit. The heat exchanger is thus maintained substantially between the upper and lower temperature limits.

A storage temperature monitor 66 is also provided for monitoring a temperature of the liquid in the liquid storage tank. The storage temperature monitor 66 is supported in the boundary wall of the storage tank, spaced apart laterally from the heat exchanger tank, at an elevation which is near a vertical center of the storage tank and the heat exchanger tank respectively. The storage temperature monitor communicates through the boundary wall of the storage tank so as to be in contact with the liquid stored in the storage tank 12. The controller 60 in this instance is arranged to cease operation of the burner head responsive to a temperature of the liquid as monitored by the storage temperature monitor exceeding a prescribed upper temperature limit regardless of the condition sensed by the heat exchanger temperature monitor. More particularly, if the liquid temperature in the storage tank exceeds the respective upper storage temperature limit, the burner head is not operated even if the heat exchanger temperature monitor indicates a temperature below the upper limit thereof.

Another one of the sensors associated with the controller is a fluid level monitor 62 which is supported on the outer end wall 28 of the heat exchanger tank 20 adjacent to the top end of the heat exchanger tank to communicate through the end wall with fluid inside the tank. More particularly, the fluid level monitor 62 is arranged to monitor a level of heat exchanger fluid in the heat exchanger tank by determining if the fluid is in contact with the monitor or not. The monitor is mounted above the height of the burner tubes to define a minimum operational height of the liquid which the burner tube within the heat exchanger tank fully submerged within the liquid heat exchanger fluid. The controller 60 monitors if fluid is in contact with the monitor 62 to determine if the height of the fluid is above or below the level of the monitor 62. Accordingly the controller can be arranged to cease operation of the burner head 16 responsive to a liquid level of the heat exchanger fluid falling below a prescribed lower level limit defined by the location of the monitor as indicated by a lack of liquid contact with the monitor 62. The operation of the burner head is prevented in the instance of a fluid level below the fluid level monitor 62 even if the temperature monitors indicate a heating demand.

Also shown in FIG. 5, an overflow tank 68 is supported externally of the storage tank 12 and the heat exchanger tank 20 by being supported along an exterior of the outer end wall 28 of the heat exchanger tank and along an exterior of one of the boundary walls of the storage tank 12. The overflow tank 68 locates a surplus of the heat exchanger fluid therein. The overflow tank 68 is elongate in a vertical direction and is supported such that a majority of the tank extends upwardly above the top end of the heat exchanger tank 20. An overflow passage 70 in the form of a small diameter tube or pipe is in open fluid communication between a bottom end of the overflow tank and a top end of the heat exchanger tank so as to be arranged to permit expansion of the heat exchanger fluid from the heat exchanger tank into the overflow tank and so as to ensure the heat exchanger tank remains always full in its entirety with heat exchanger fluid. The top end of the overflow tank includes a vent 72 which is vented to atmospheric pressure.

FIG. 5 further illustrates a drain fitting 74 in communication through the outer end wall 28 of the heat exchanger tank 20 adjacent the bottom end thereof. The drain fitting 74 can be capped or provided with a valve to maintain the fitting in a closed state under normal operation. The drain fitting is typically only opened when it is desired to drain the heat exchanger fluid from the heat exchanger tank, for example when performing maintenance on the assembly.

A thermometer 76 can also be mounted externally on the outer end wall 28 of the heat exchanger tank to display temperature of the fluid within the heat exchanger tank as measured by the thermometer in communication with the fluid.

The assembly according to FIG. 5 is operated in the manner described above to heat contents of the storage tank for treatment and the like. In a preferred embodiment, the storage tank receives produced hydrocarbons therein which may be heated for example to assist in the settling of sand from the oil. The controller 60 receives data from the various monitors described above and operates the burner head to maintain the heat exchanger fluid between upper and lower limits, while simultaneously ensuring that the temperature of the contents of the storage tank remain between upper and lower limits. For added safety, the burner is prevented from operating if the fluid level in the heat exchanger tank falls below a prescribed limit.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A heating assembly in combination with a liquid storage tank having walls surrounding a hollow interior containing a stored liquid comprising a produced hydrocarbon therein and a production source separate from the liquid storage tank containing produced hydrocarbons therein, the assembly comprising:

a heat exchanger tank including boundary walls containing a heat exchanger liquid therein which is different from the stored liquid in the liquid storage tank;

a burner head supported externally of the liquid storage tank;

a heating apparatus adapted to generate heat, the heating apparatus being supported within the heat exchanger tank so as to be surrounded by the heat exchanger liquid within the heat exchanger tank;

the heating apparatus comprising a burner tube defining an exhaust passage communicating from an inlet end coupled to the burner head to an outlet end vented to atmosphere such that the exhaust passage is arranged to receive products of combustion from the burner head therethrough;

the heat exchanger tank being supported within the liquid storage tank such that (i) the stored liquid in the liquid storage tank surrounds the heat exchanger tank and (ii) the heat exchanger liquid is contained in the heat exchanger tank so as to be kept separate from and isolated from the stored liquid in the liquid storage tank that surrounds the heat exchanger tank;

a liquid level monitor supported on the heat exchanger tank adjacent to a top end of the heat exchanger tank and above a main portion of the burner tube which is within the heat exchanger tank;

the liquid level monitor being in operative connection to the burner head so as to be arranged to cease operation of the burner head responsive to a liquid level of the heat exchanger liquid falling below a level of the liquid level monitor such that (i) the burner tube is fully submerged in the heat exchanger liquid and (ii) heat generated by the heating apparatus is arranged to be communicated from the heating apparatus to the stored liquid in the liquid storage tank primarily through the heat exchanger liquid and the boundary walls of the heat exchanger tank; and a production passage received within the heat exchanger tank and communicating through the heat exchanger tank between an inlet end of the production passage in communication with the production source so as to receive the produced hydrocarbons therefrom and an outlet end of the production passage in communication with the hollow interior of the liquid storage tank so as to communicate the produced hydrocarbons in the production passage into the hollow interior of the liquid storage tank;

the production passage being in heat exchanging relationship with the heating assembly below the liquid level monitor through the heat exchanger liquid that surrounds the production passage while receiving the produced hydrocarbons therein which are communicated from the production source to the hollow interior of the liquid storage tank.

2. The assembly according to claim 1 wherein the heat exchanger tank is arranged to be supported within the liquid storage tank such that the burner tube cannot directly communicate with the hollow interior of the liquid storage tank and heat is only communicated from the burner tube to the stored liquid in the liquid storage tank through the heat exchanger liquid.

3. The assembly according to claim 1 wherein the heat exchanger tank is in sealing engagement with one of the walls of the liquid storage tank.

4. The assembly according to claim 1 wherein the heat exchanger tank is arranged to extend horizontally inward from an upright boundary wall of the liquid storage tank.

5. The assembly according to claim 1 wherein a volume of the heat exchanger liquid in the heat exchanger tank is fixed.

6. The assembly according to claim 5 further comprising an overflow tank located externally of the heat exchanger tank and an overflow passage in communication between the overflow tank and the heat exchanger tank so as to be arranged to permit expansion of the heat exchanger liquid from the heat exchanger tank into the overflow tank.

7. The assembly according to claim 1 further comprising a heat exchanger temperature monitor arranged to monitor a temperature of the heat exchanger liquid in the heat exchanger tank, and a controller arranged to cease heating operation of the heating apparatus responsive to a temperature of the heat exchanger liquid as monitored by the heat exchanger temperature monitor exceeding a prescribed upper temperature limit.

8. The assembly according to claim 1 further comprising a heat exchanger temperature monitor arranged to monitor a temperature of the heat exchanger liquid in the heat exchanger tank, and a controller arranged to actuate heating operation of the heating apparatus responsive to a temperature of the heat exchanger liquid as monitored by the heat exchanger temperature monitor falling below a prescribed lower temperature limit.

9. The assembly according to claim 1 further comprising a storage temperature monitor arranged to monitor a temperature of the stored liquid in the liquid storage tank, and a controller arranged to cease operation of the heating apparatus responsive to a temperature of the stored liquid as monitored by the storage temperature monitor exceeding a prescribed upper temperature limit.

10. The assembly according to claim 1 wherein the inlet end and the outlet end of the burner tube communicate through a common wall of the heat exchanger tank so as to be arranged to communicate through a common wall of the liquid storage tank.

11. The assembly according to claim 1 wherein the heat exchanger tank includes a perimeter flange projecting outwardly from the boundary walls about a circumference of the heat exchanger tank, the perimeter flange being arranged to be mounted in sealing engagement about a perimeter of an opening in the wall of the liquid storage tank.

12. The assembly according to claim 11 wherein the perimeter flange is defined by a perimeter edge of an end wall at one end of the heat exchanger tank.

13. The assembly according to claim 11 wherein the perimeter flange includes spaced apart mounting apertures formed therein so as to be arranged to secure the flange to the perimeter of the opening in the wall of the liquid storage tank using threaded fasteners.

14. The assembly according to claim 1 wherein the heat exchanger liquid comprises glycol.

15. The assembly according to claim 1 wherein the production passage follows a sinuous path through the heat exchanger tank.

* * * * *